US011389712B2

(12) United States Patent
Butler, Jr.

(10) Patent No.: US 11,389,712 B2
(45) Date of Patent: Jul. 19, 2022

(54) GAME LIGHTING AND SCOREKEEPING ASSEMBLY

(71) Applicant: Joseph L. Butler, Jr., Avalon, NJ (US)

(72) Inventor: Joseph L. Butler, Jr., Avalon, NJ (US)

( * ) Notice: Subject to any disclaimer, the term of this patent is extended or adjusted under 35 U.S.C. 154(b) by 0 days.

(21) Appl. No.: 17/238,756

(22) Filed: Apr. 23, 2021

(65) Prior Publication Data

US 2021/0331059 A1 Oct. 28, 2021

Related U.S. Application Data

(60) Provisional application No. 63/014,313, filed on Apr. 23, 2020.

(51) Int. Cl.
*A63B 71/06* (2006.01)
*A63B 67/06* (2006.01)

(52) U.S. Cl.
CPC ..... *A63B 71/0672* (2013.01); *A63B 67/06* (2013.01); *A63B 2225/682* (2013.01); *A63B 2225/74* (2020.08)

(58) Field of Classification Search
CPC . A63B 71/0672; A63B 67/06; A63B 2225/74; A63B 2225/682
USPC ..... 273/317
See application file for complete search history.

(56) References Cited

U.S. PATENT DOCUMENTS 4,480,833 A * 11/1984 Barcelow ..... A63F 7/0684 273/108.56
5,056,796 A * 10/1991 Conville ..... A63B 67/06 273/402
5,894,261 A * 4/1999 Green ..... A63B 71/06 273/DIG. 26
7,607,666 B1 10/2009 Studier
(Continued)

FOREIGN PATENT DOCUMENTS

WO WO-2019150337 A1 * 8/2019 ..... A63B 63/004

OTHER PUBLICATIONS

"Indoor/Outdoor Tabletop Scoreboard," Palos Sports, https://www.palossports.com/store/proddetail.cfm/ItemID/9092/CategoryID/57/SubCatID/98/file.htm [Date accessed: Nov. 20, 2019].
(Continued)

*Primary Examiner* — John E Simms, Jr.
*Assistant Examiner* — Rayshun K Peng
(74) *Attorney, Agent, or Firm* — Houda El-Jarrah; Bold IP, PLLC

(57) ABSTRACT

A game lighting and scorekeeping assembly for use when playing toss games is provided. The assembly includes an upright support structure adapted to support a scorekeeping device (preferably illuminated), an illumination system for providing light onto one or more gameboards, a cup holding assembly, an audio speaker system, a bottle opener assembly, and other elements. Both the scorekeeping device and the illumination system each emit amplified light with the illumination system emitting focused light at higher lumens,
(Continued)

and as such, the game lighting and scorekeeping assembly is designed to minimize the interference between the light emitted by the scorekeeping device and the light emitted by the illumination system. In this regard, the scorekeeping device is positioned at a higher elevation on the game lighting and scorekeeping assembly above the illumination system.

18 Claims, 7 Drawing Sheets

(56) References Cited

U.S. PATENT DOCUMENTS

| | | | | |
|---|---|---|---|---|
| 2009/0051133 | A1* | 2/2009 | Oshiro | B62B 1/12 273/348 |
| 2010/0033960 | A1* | 2/2010 | Levine | F21S 6/003 362/198 |
| 2013/0045821 | A1* | 2/2013 | Dugdale | A63B 43/06 473/413 |
| 2013/0119006 | A1 | 5/2013 | Graga et al. | |
| 2019/0313787 | A1 | 10/2019 | Bennett | |

OTHER PUBLICATIONS

"DIY Drink Stands with Integrated Scoreboards, Illumination Devices, Bottle Openers and/or Speakers" (Various Sources), Pinterest, https://www.pinterest.ca/pin/310326849122720 56/?lp=true [Date Accessed: Nov. 20, 2019].

"Koozy Kaddy—Elevated Drink Holders," The Green Head, https://www.thegreenhead.com/2012/05/koozy-kaddy-elevated-drink-holders.php [Date Accessed: Nov. 20, 2019].

* cited by examiner

GAME LIGHTING AND SCOREKEEPING ASSEMBLY

CROSS-REFERENCE TO RELATED APPLICATIONS

This application claims priority to U.S. Provisional Application No. 63/014,313 filed Apr. 23, 2020, the entire contents of which are hereby fully incorporated herein by reference for all purposes.

FIELD OF THE INVENTION

This invention relates to game assemblies, including outdoor toss game assemblies with lighting and scorekeeping devices.

BACKGROUND

Toss games such as corn hole, horseshoes, lawn darts, and other types of outdoor toss games are very popular worldwide. The games are typically played during social gatherings such as at picnics and parties, and may be played in parks, backyards, on the beach, or in other areas.

The games are typically played during the day when there is sufficient ambient lighting for the players to see the associated game boards. However, when there is insufficient ambient lighting (e.g., at night), playing the games becomes very difficult.

In addition, the games are typically played using cancellation scoring until one player or team reaches or exceeds a score of 21, making it difficult to remember each player's score during the game play, and often leading to arguments and players becoming disgruntled with one another.

Also, during the playing of such games, players may wish to open bottled beverages and to have a place to rest the beverages during their game turn. The players may also wish to listen to music which may make the overall experience of the game more enjoyable.

Accordingly, there is a need for an assembly that may be used during the playing of various toss games that includes a scorekeeping device, a cup holder assembly, a bottle opening device, an audio speaker system, and an illumination system to illuminate the game boards when there is insufficient ambient lighting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the game lighting and scorekeeping assembly according to exemplary embodiments hereof provides a mount or stand adapted to support various apparatuses and/or devices. In some embodiments, the game lighting and scorekeeping assembly may be used by persons participating in a game activity such as an outdoor toss game. In some embodiments, the game lighting and scorekeeping assembly is adapted to support apparatuses and/or devices such as scorekeeping device(s), lighting device(s), cup holder device(s), bottle opening device(s), audio speaker(s), and/or other devices that may provide beneficial functionalities to participants during the game play.

In some embodiments, the game lighting and scorekeeping assembly is used in conjunction with the playing of outdoor games such as toss games and/or other types of games. For example, the assembly may be used with games such as cornhole, ladder toss, horseshoes, washer pitching, lawn darts and other types of outdoor games.

For the purposes of this specification, the game lighting and scorekeeping assembly will be described primarily in relation to being used in conjunction with the playing of cornhole. However, a person of ordinary skill in the art will understand that the assembly may be used in conjunction with the playing of any type of game and that the scope of the assembly is not limited in any way by the game with which it is used.

In order to provide additional insight into the device game lighting and scorekeeping assembly and its benefits, some general background information regarding the game of corn hole is provided below.

Cornhole (also known regionally as bags, sack toss, or bean bag) is a lawn game in which players take turns throwing 16-ounce bags of corn kernels at opposing raised platforms (game boards), each with a hole in the far end.

Figure 1:
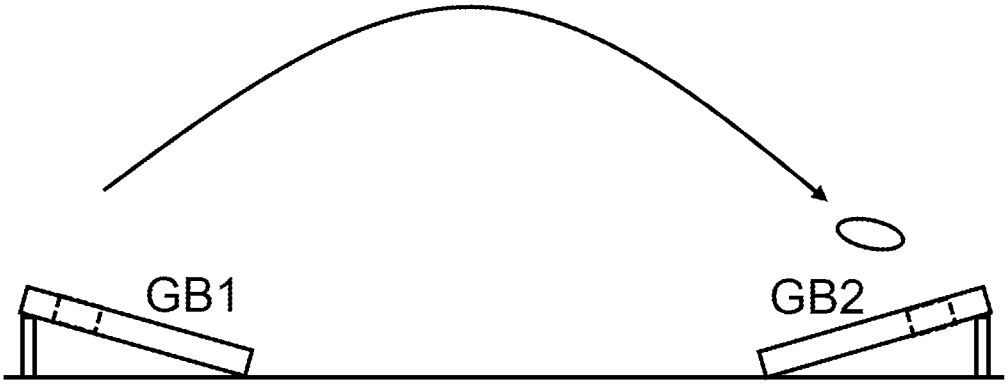
FIG. 1 shows aspects of a toss game according to exemplary embodiments hereof.

Cornhole matches are played with two sets of bags, two boards and two to eight players. Each set of bags (with four bags each) are identifiable from the other, typically being of different colors. As shown in FIG. 1, the two game boards GB1, GB2 are placed opposing one another, and the players take turns standing next to the first game board GB1 while throwing the bags at the second game board GB2. The bags are then collected and scored, and the players subsequently throw the bags in the opposite direction back to the first game board GB1 while standing next to the second game board GB2, and so on.

Each board is 2 feet wide and 4 feet long (0.61 m by 1.22 m), with a 6-inch (150 mm) hole centered 9 inches (230 mm) from the far end. When placed on the ground for game play, each board is angled with the far end edge of the playing surface 12 inches (300 mm) above the ground, and the front-end edge 3-4 inches (76-102 mm) above the ground. A regular corn hole court places two game boards opposing one another with the holes of each board 33 feet (10 m) apart, or 27 feet (8.2 m) between the front-end edges of the platforms. Shorter distances may be used when younger players are participating or there is not sufficient room.

Bags are tossed from the pitcher's box, which is the rectangular area directly to the left or right of a platform. The bottom of the platform forms the foul line.

In order to score, the bags must either be tossed into the hole or land on the board. A bag that falls through the hole is worth three points. The bag can be tossed directly into the hole, slide into the hole, or be knocked into the hole by another bag. A bag that lands on the board and is still on the board at the end of the inning is worth one point.

Scoring is done by cancellation (e.g., if Team A scores 12 points in the frame and Team B scores 10 points in the frame, Team A is awarded 2 points (12–10=2) and Team B is awarded zero points). Play continues until a player or team reaches or exceeds 21 points.

Figure 2:
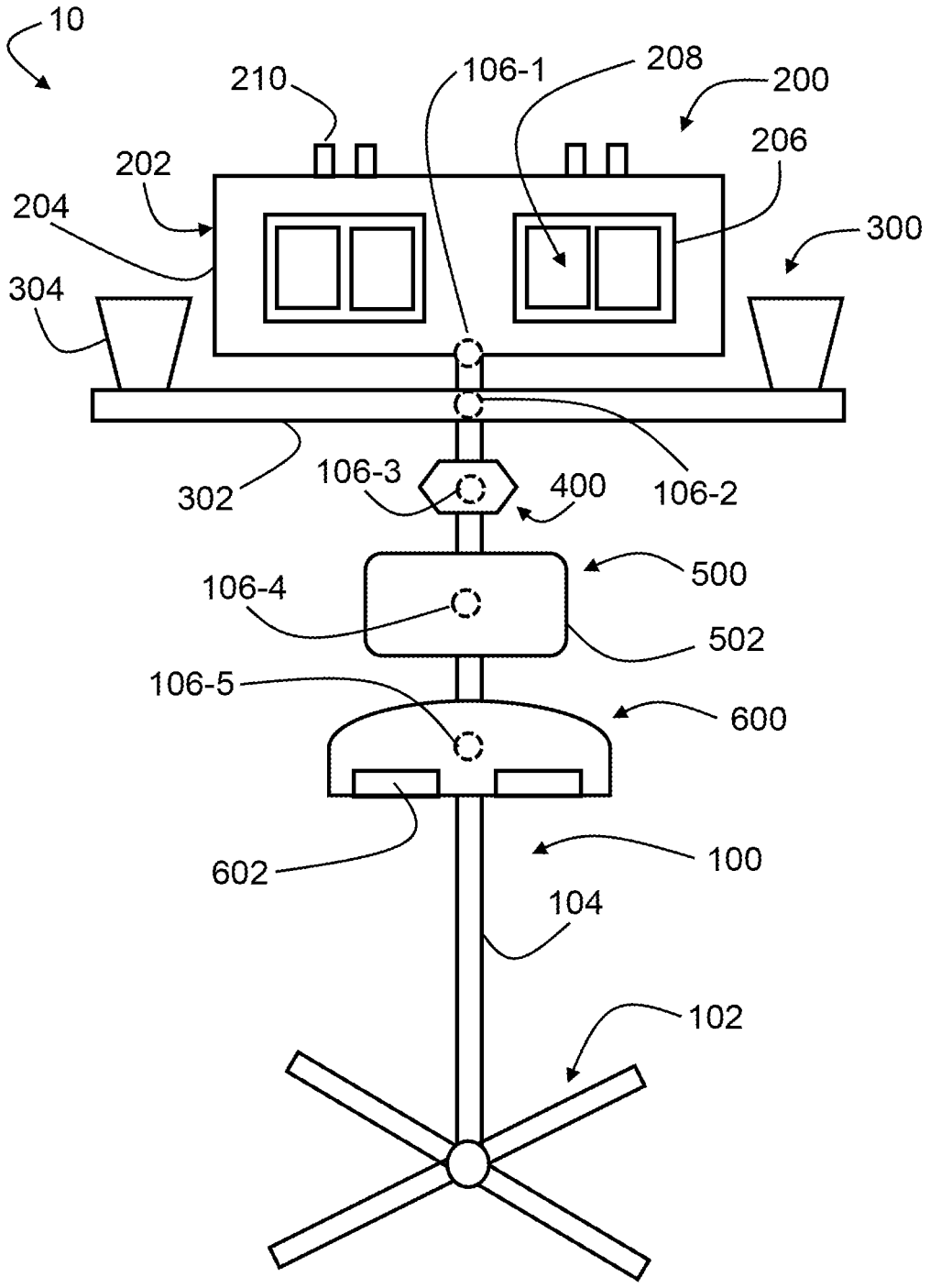
FIG. 2 shows aspects of a game lighting and scorekeeping assembly according to exemplary embodiments hereof.

In one exemplary embodiment hereof as shown in FIG. 2, the game lighting and scorekeeping assembly 10 includes a support assembly 100, a scorekeeping device 200, a cup holding assembly 300, a bottle opening device 400, an audio speaker system 500, and an illumination system 600. In general, the support assembly 100 provides support to the scorekeeping device 200, the cup holding assembly 300, the bottle opening device 400, the audio speaker system 500, and/or the illumination system 600. Other versions of the assembly 10, such as the folding assembly 12, also are provided herein and are all within the scope of the assembly 10. The assembly 10 also may include other elements and components as necessary to perform its desired functionalities as described herein or otherwise.

Support Assembly 100

In some embodiments, as shown in FIG. 2, the support assembly 100 includes a base 102 and an upright support 104. The base 102 may comprise a lower floor-standing structure with an adequate architecture to support the upright support 104 and the devices and systems supported thereon (e.g., the scorekeeping device 200, the cup holding assembly 300, the bottle opening device 400, the audio speaker system 500, and/or the illumination system 600).

In some embodiments, the base 102 may include any adequate type base 102 such as a cross-leg four-point base depicted in FIG. 2, a round base, and/or any other form of base 102 that may include a lateral footprint adequate to support the other elements of the assembly 10. In some embodiments, the base 102 may include a lateral footprint of about 2'×2' (or a 2' radius if circular) or greater.

In some embodiments, the base 102 may be adapted to rest on a generally hard surface (e.g., a tiled patio or concrete driveway) and may include one or more levelling feet that may be adjusted to set the level of the base 102 and of the overall support assembly 100. In other embodiments, the base 102 may be adapted to rest on a generally penetrable and/or uneven surface (e.g., a grass lawn) and may include one or more foot spikes for engaging the soft surface and attaining support therefrom. It is understood that the base 102 may be adapted to rest on any type(s) of surfaces upon which the game may be played.

In some embodiments, the upright support 104 includes one or more poles, posts, columns, towers and/or other types of upright structure(s) mounted to the base 102 on its bottom end and extending upward an adequate height. In some embodiments, the upright support 104 may extend upward 3'-6' or other heights as required. In some embodiments, the upright support 104 extends generally vertically upward, while in other embodiments the support 104 extends upwards at one or more angles. In addition, in some embodiments the upright support 104 is fixedly attached to the base 102 while in other embodiments the upright support 104 is rotatably attached to the base 102 (as described in other sections in relation to a foldable version of the assembly 10).

In some embodiments, the height of the upright support 104 is adjustable (e.g., using telescopic poles or other elements) so that the user may adjust the height of the assembly 10 to any desirable height.

In some embodiments, the upright structure 104 includes one or more mounting mechanisms 106-1, 106-2, 106-3, . . . **106-*n* (individually and collectively 106) that may each be adapted to mount another element to the upright structure 104. For example, the upright structure 104 may include a first mounting mechanism 106-1 adapted to mount the scorekeeping device 200 to the upright structure 104, a second mounting mechanism 106-2 adapted to mount the cup holder assembly 300, a third mounting mechanism 106-3 adapted to mount the bottle opening device 400, a fourth mounting mechanism 106-4 adapted to mount the audio speaker system 500, and a fifth mounting mechanism 106-5 adapted to mount the illumination system 600**.

In some embodiments, as shown in FIG. 2, the fifth mounting mechanism 106-5 is positioned lower on the upright structure 104 relative to the first mounting mechanism 106-1. In this way, the illumination system 600 may be mounted on the upright structure 104 below the scorekeeping device 200. The purpose for this is that the scorekeeping device 200 and the illumination system 600 may both emit amplified light, and it is preferable that the amplified light emitted by the illumination system 600 not interfere with the amplified light emitted by the scorekeeping device 200, and vice versa. This will be described in detail in other sections.

In one exemplary embodiment hereof, the location of any mounting mechanisms 106 may be adjustable with respect to any other mounting mechanisms 106 and/or the upright structure 104. That is, a mounting mechanism 106 may be positioned along the height of the upright structure 104 by the user at any location so that the position of any element secured by the mounting mechanism 104 may also be adjusted as desired. In addition, a mounting mechanism 106 may be removed if not needed and/or added if additional mounting mechanisms 106 are required to secure the same and/or additional elements to the upright structure 104.

It is understood that the mounting mechanisms 106-1, 106-2, 106-3, 106-4, 106-5, 106-6 described above are meant for demonstration and that any type and/or number of attachment mechanisms 106 may be used in conjunction with any of the elements of the assembly 10. It is also understood that the mounting mechanisms 106 may be interchanged (e.g., to secure other elements of the assembly 10) or used in any way to secure any type of element to the assembly 10.

Scorekeeping Device 200

In some embodiments, as shown in FIG. 2, the scorekeeping device 200 includes an electronic scoreboard 202. The electronic scoreboard 202 may include a housing 204 and illuminated readouts 206. The housing 204 may generally house the electronics and other internal components of the scorekeeping device 200 to power and generally control the illuminated readouts 206, and the illuminated readouts 206 may be configured on an outer surface of the housing 204 to be viewable from the outside. The housing 204 may comprise plastic, metal, other materials, and any combination thereof, and may preferably be waterproof and/or water-resistant.

The illuminated readouts 206 may include one or more LED readouts or other types of illuminated readouts 206. It is preferable that the illuminated readouts 206 be of adequate brightness and size to be viewable from a distance sufficient to support the game being played. For example, for a pair of assemblies 10 being used in conjunction with the playing of cornhole, with one assembly 10 generally positioned with each opposing game board (at spacings of 33'), the illumination readouts 206 are preferably viewable from distances of 33' and greater.

In some embodiments, the illuminated readout 206 includes two readout frames 208, with the first readout frame 208 displaying the score of the first player or first team of players, and the second readout frame 208 displaying the score of the second player or second team of players. Because each game of cornhole is played until a player or team reaches a score of 21, it is preferable that each readout frame 208 includes at least two single digit positions so that double digit numbers (scores) may be displayed. The two readout frames 208 may be positioned side-by-side on the housing, one above the other, or in any other suitable orientation, and are preferably labeled to designate which player or team each readout frame 208 may represent (e.g., first player vs. second player).

In some embodiments, the illuminated readouts 206 (and the corresponding readout frames 208) are manually controlled via control mechanisms 210 configured with the exterior of the housing 204. For example, the control mechanisms 210 may include one or more exterior buttons, knobs, or other types of mechanisms that when activated (e.g., pressed or turned) may increment the displayed score on the corresponding readout frame 208 up or down. Given that each readout frame 208 may require incrementing independent from the other readout frame 208, it may be preferable that each readout frame 208 include one or more dedicated control mechanisms 210. The control mechanisms 210 also may reset the frame readouts 208 to zero (e.g., for the start of a new game).

In one exemplary embodiment hereof, when two assemblies 10 are being used during a game of corn hole, with a first assembly 10-1 dedicated to the first game board and a second assembly 10-1 dedicated to the second game board, the scorekeeping device 200-1 configured with the first assembly 10-1 and the scorekeeping device 200-2 configured with the second assembly 10-2 may be communicatively linked so that when the first scorekeeping device 200-1 is incremented, the second scorekeeping device 200-2 is automatically also incremented. In some embodiments, the first and second scorekeeping devices 200-1, 200-2 may be linked using wireless communications technologies such as Bluetooth, Wi-Fi, or other technologies that may enable the scorekeeping devices 200-1, 200-2 to communicate with one another and trigger one another to increment accordingly. In other embodiments, the first and second scorekeeping devices 200-1, 200-2 may be connected to one another using a wire or other type of transmission line that may facilitate the communication.

In some embodiments, the scorekeeping device 200 includes other functionalities such as (without limitation) a program timer, a stopwatch, a clock, an alarm, a possession indicator, a horn/buzzer, a metronome, and other features.

In some embodiments, the scorekeeping device 200 may be controlled via a remote control that may include the same or similar functionalities as the control mechanisms 210 but that may be used remotely from a distance (e.g., 100'), e.g., to increment the readout frames 208. In some embodiments, the remote control may be adapted to increment two scorekeeping devices 200-1, 200-2 that may be used together during a game of cornhole as described above.

The scorekeeping device 200 may include an internal rechargeable battery, solar panels, may be plugged into an electrical outlet or generator for power, and/or may include other types of power supplying devices.

The size of the scorekeeping device 200 may vary depending on the application of the assembly 10, and in some embodiments may measure about 24" wide by 16" tall by 10" deep.

In some embodiments, the scorekeeping device 200 is configured with the support assembly 100, e.g., with the upper portion of the upright support 104. The scorekeeping device 200 may include a bracket or mount that may support the scorekeeping device 200 and that may be configured with the upper portion of the upright support 104 (e.g., to the top of the support 104), e.g., using the mounting mechanism 106-1. It may be preferable that the mounting mechanism 106-1 include a rotatable mounting mechanism so that the scorekeeping device 200 may be rotated about the longitudinal axis of the upright support 104 and/or about an axis perpendicular to the longitudinal axis of the upright support 104 so that it may be adjusted to generally face those who wish to view it.

Cup Holder Assembly 300

In some embodiments, as shown in FIG. 2, the cup holder assembly 300 includes a lateral support 302 attached to the upright support 104 (e.g., using the mounting mechanism 106-2). The lateral support 302 may be configured with and provide support to one or more holders 304 adapted to hold cups, cans, bottles, pitchers, jars, other types of containers and any combination thereof. In one embodiment, each holder 304 may include a generally conical shaped body with the larger diameter side facing upward so that it may accommodate cups and other containers of varying diameters.

In some embodiments, the lateral support 302 may also act as a shelf for holding other items such as cell phones, plates, keys, wallets, and other types of items that players of the game may wish to store. The lateral support 302 also may include compartments, openings, hooks, depressions, other elements for holding or storing items, and any combination thereof. In some embodiments, lateral support 302 may include a lip on the border to minimize items falling off of lateral support 302.

Bottle Opening Device 400

In some embodiments, the beverage opening device 400 may include any type of bottle opening device as is known in the art.

In some embodiments, the bottle opening device 400 may be mounted on the upright support 104 using the mounting mechanism 106-3 (e.g., screws, clamps, bolts, adhesive, etc.). In other embodiments, the bottle opening device 400 may be mounted on the lateral support 302 or on other elements of the assembly 10. In any event, it is preferable that the bottle opening device 400 be easily accessible and arranged in such a way that it may easily accommodate any size bottle that may need to be opened.

Audio Speaker System 500

In some embodiments, the audio speaker system 500 includes one or more audio speakers 502. In some embodiments, the audio speaker system 500 also may include wireless communication electronics so that it may receive signals from a transmitter and subsequently broadcast the signals as audio waves (e.g., as music). For example, the audio speaker system 500 may include Bluetooth electronics so that it may be paired with a transmitter (e.g., a smartphone or tablet computer) to receive and broadcast music or other types of audio received from the transmitter. Other types of wireless communication protocols also may be used such as Wi-Fi, telephony, other types so communication protocols and any combination thereof.

In some embodiments, the audio speaker system 500 includes a radio receiver that may receive amplitude modulated (AM) and/or frequency modulated (FM) signals from transmitters such as local radio stations. In other embodiments, the audio speaker system 500 includes a satellite receiver that may receive signals from one or more satellites, and subsequently broadcast the signals as audio waves.

In some embodiments, the audio speaker system 500 includes transmission lines that may connect it to one or more transmitters to receive signals and broadcast them as audio waves.

In some embodiments, the audio system 500 includes volume controls, frequency tuning controls, and other types of controls as necessary for its use.

In some embodiments, the audio speaker system 500 may include an internal rechargeable battery, solar panels, may be plugged into an electrical outlet or generator for power, and/or may include other types of power supplying devices.

The audio speaker system 500 may be configured to the upright support 104 using the mounting mechanism 106-3. Alternatively, if the user already has a separate wireless speaker that he/she may wish to use, a mounting mechanism 106 and/or the assembly 10 may include a shelf or some other mounting mechanism to mount the user's pre-existing wireless speaker.

Illumination System 600

In some embodiments, the illumination system 600 includes one or more illumination device(s) 602 adapted to transmit light onto one or more game boards when the game boards are used in an environment with insufficient ambient lighting to adequately play the game (e.g., at nighttime). The illumination device(s) 602 may include LEDs, incandescent light bulbs, fluorescent lamps, Halogen lamps, neon lamps, spotlights, other types of illumination devices, and any combination thereof. The illumination device(s) 602 also may include lenses that may focus, align, concentrate, diffuse, or otherwise affect the emitted light. For example, it may be preferable that the light emitted by the illumination system 600 be focused onto an accompanying gameboard and that the light be focused onto the board using a lens or other type of directional light source.

In some embodiments, the illumination system 600 may be configured to the upright support 104 using the mounting mechanism 106-5. The mounting mechanism 106-5 may include a rotatable mounting mechanism such that the angular orientation of the illumination device 602 may be set to different angular settings in order to aim the emitted light as desired (e.g., onto a gameboard below). The emitted light may preferably be white light, but other colors of light may also be emitted.

Figure 3:
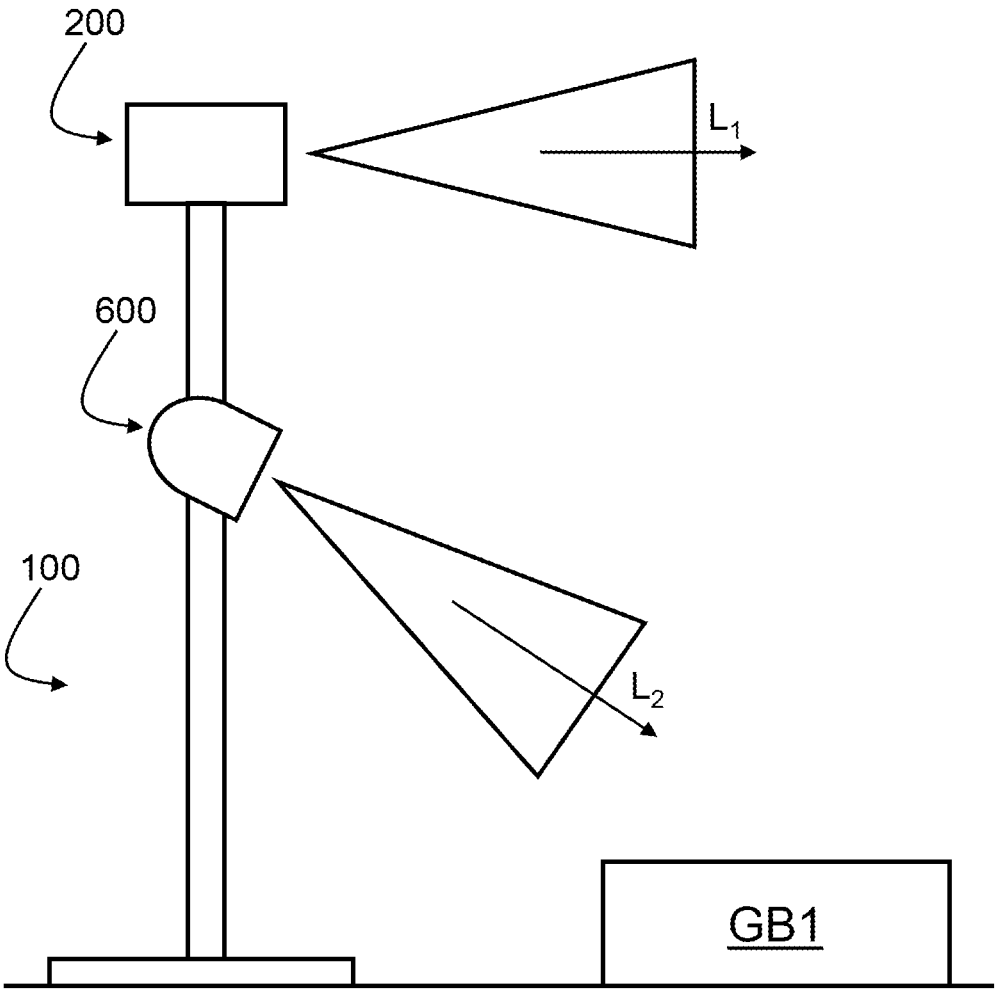
FIG. 3 shows aspects of a game lighting and scorekeeping assembly and a single accompanying game board according to exemplary embodiments hereof.

In some embodiments as shown in FIG. 3, one assembly 10 may be positioned in close proximity to each game board such that each assembly 10 may be adapted to illuminate the game board at which is it positioned. In this case, the illumination device(s) 602 are adapted to emit light at a downward angle in order to sufficiently illuminate the game board positioned below (e.g., a corn hole game board resting on the ground in close proximity to the assembly 10). It is preferable that the illumination devices 602 emit light of sufficient lumens so as to sufficiently illuminate the game board (e.g., its top playing surface and the top hole) so that player(s) located at an opposing game board (e.g., 33' away) who are aiming for the illuminated game board may easily see the entire game board, the entire top game board surface, any bags that may be resting on the game board surface, and the hole at which they may be aiming.

Figure 4:
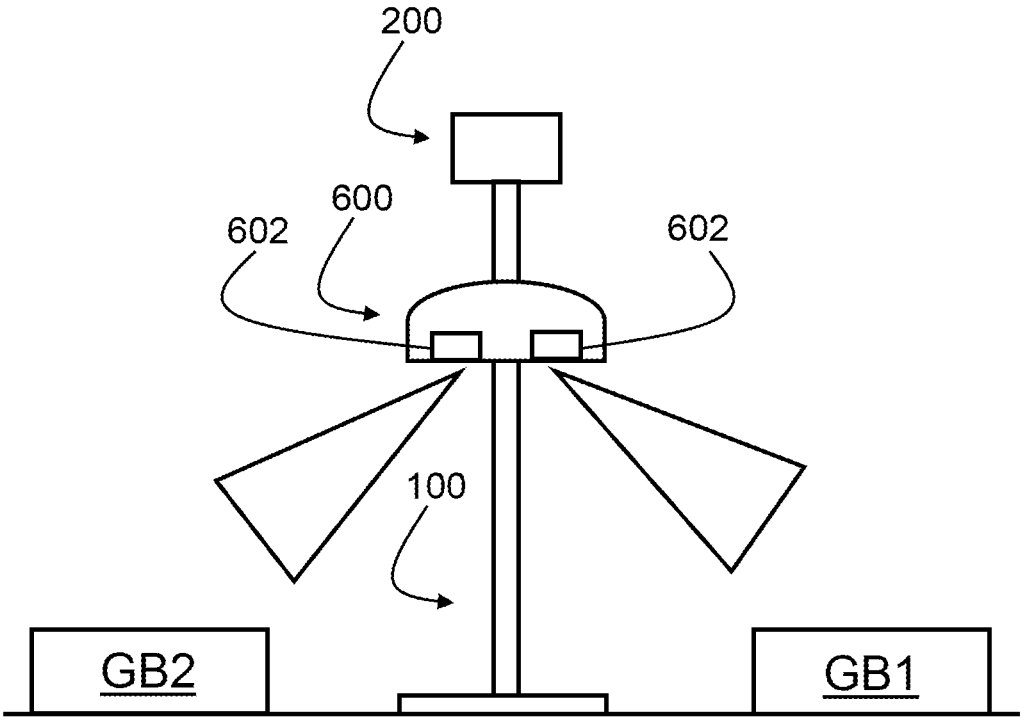
FIG. 4 shows aspects of a game lighting and scorekeeping assembly and multiple accompanying game boards according to exemplary embodiments hereof.

In some embodiments, one assembly 10 may be positioned such that it may be adapted to illuminate two or more distinct game boards simultaneously as shown in FIG. 4. In this case, the illumination device(s) 602 may be adapted to emit light over a broader area in order to sufficiently illuminate the two or more game boards with sufficient lumens (e.g., each game board's top playing surface and top hole) so that player(s) located at either opposing game board (e.g., 33' away from one another) may easily see each entire game board, each entire top game board surface, any bags that may be resting on either game board surface, and the holes on each game board at which they may be aiming.

For example, as shown in FIG. 4, a first illumination device 602 may be aimed to illuminate a first game board GB1, and a second illumination device 602 may be aimed to illuminate a second game board GB2. It is understood that the assembly 10 may include any number of illumination devices 602 aimed to illuminate any number of game boards.

Positioning of the Elements

In some embodiments as shown in FIG. 3, the illumination system 600 is mounted on the upright structure 104 below the scorekeeping device 200 (e.g., mounting mechanism 106-5 is positioned lower on the upright structure 104 compared to mounting mechanism 106-1). The purpose for this is that the scorekeeping device 200 and the illumination system 600 may each emit amplified light, and it is preferable that the amplified light emitted by the illumination system 600 not interfere with the amplified light emitted by the scorekeeping device 200, and vice versa. For example, the scorekeeping device 200 may emit light $L_1$ and the illumination system 600 may emit light $L_2$, each in the distinct directions shown. Given this example, it is preferable that the light $L_1$ in the first direction does not interfere with the light $L_2$ in the second direction.

As is understood, light $L_1$ emitted by the scorekeeping device 200 is meant to be visible from a distance (such that the information displayed on the scorekeeping device 200 may be seen and read by the players) but is not meant to illuminate other objects. In contrast, the light $L_2$ emitted by the illumination system 600 is specifically meant to illuminate other objects (e.g., the game board GB1) and thus may be emitted at a much higher intensity (higher lumens) than the light $L_1$ emitted by the scorekeeping device 200.

Figure 5:
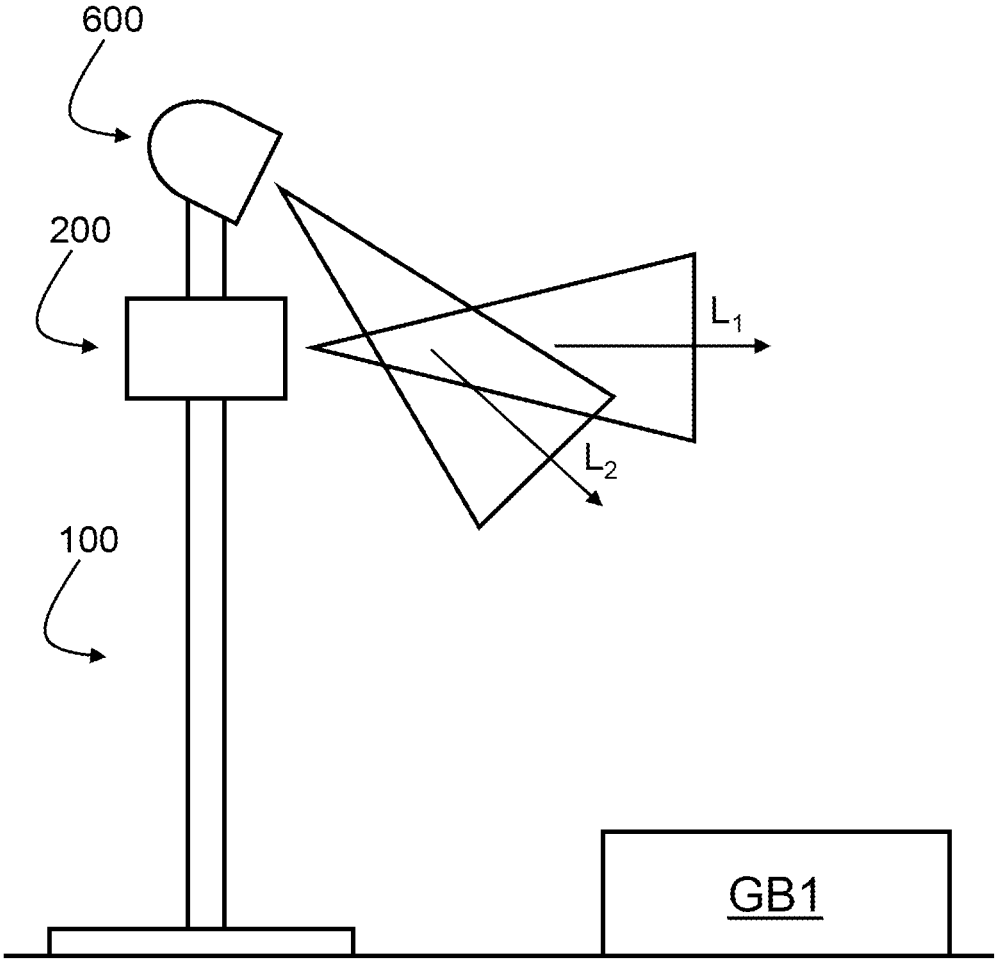
FIG. 5 shows aspects of an unpreferable game lighting and scorekeeping assembly architecture and accompanying game board according to exemplary embodiments hereof

Accordingly, if the illumination system 600 is positioned such that the light $L_2$ it may emit crosses in front of or is otherwise somewhat aligned with the light $L_1$ emitted by the scorekeeping device 200, the light $L_2$ from the illumination system 600 may mask out, overpower, wash out, or otherwise make the light $L_1$ emitted from the scorekeeping device 200 difficult to see by the players of the game. This unpreferable arrangement is shown in FIG. 5.

Therefore, the illumination system 600 of the assembly 10 is positioned below the scorekeeping device 200 in order to avoid this problem. This is shown in FIG. 3. Accordingly, the light $L_1$ is directed generally outward at a higher elevation than the light $L_2$, and the light $L_2$ is directed generally downward at a lower elevation than the light $L_1$. In this way, the light $L_2$ may not mask out the light $L_1$, especially from afar.

Foldable Assembly 12

Figure 6:
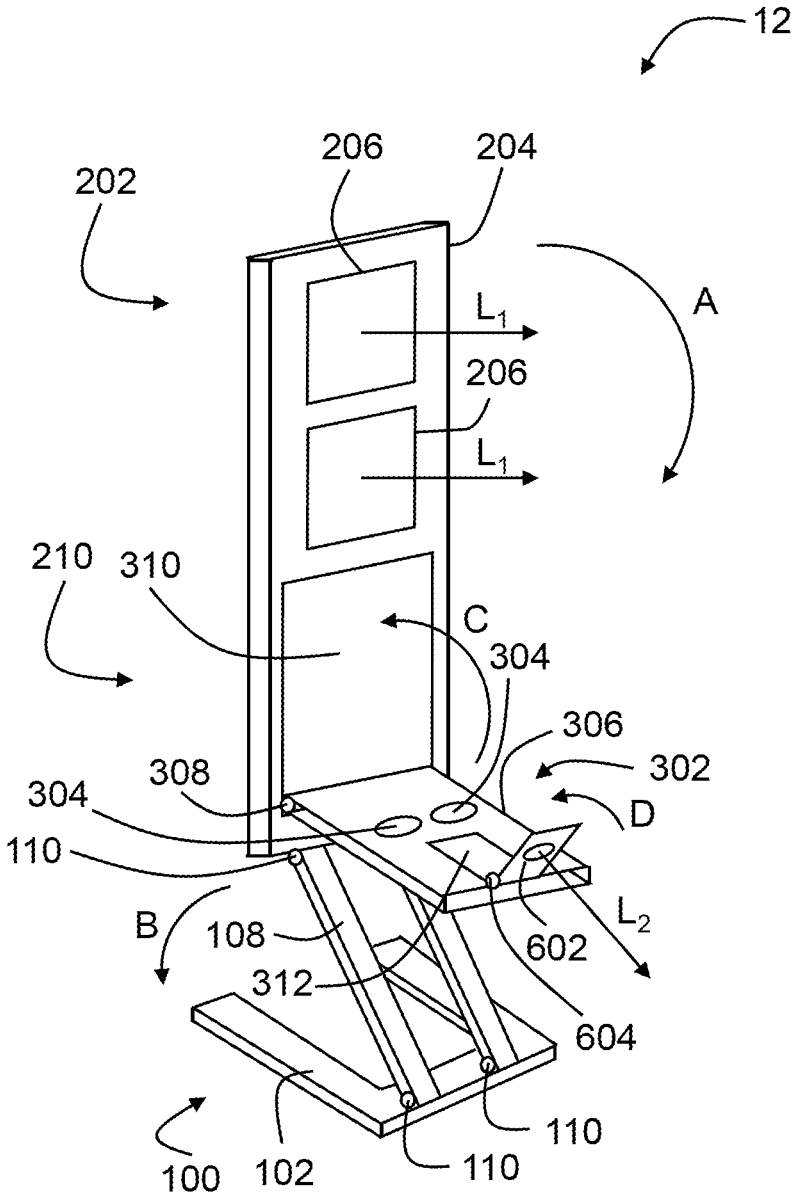
FIG. 6 shows aspects of a foldable game lighting and scorekeeping assembly according to exemplary embodiments hereof.
Figure 7:
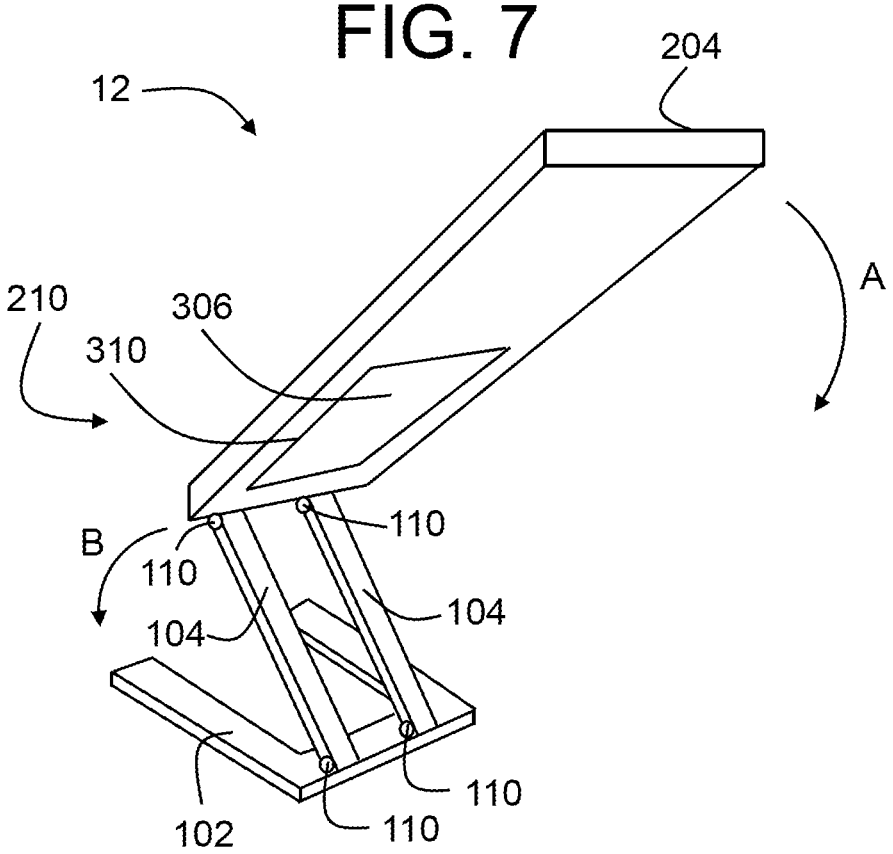
FIG. 7 shows aspects of a foldable game lighting and scorekeeping assembly according to exemplary embodiments hereof.
Figure 8:
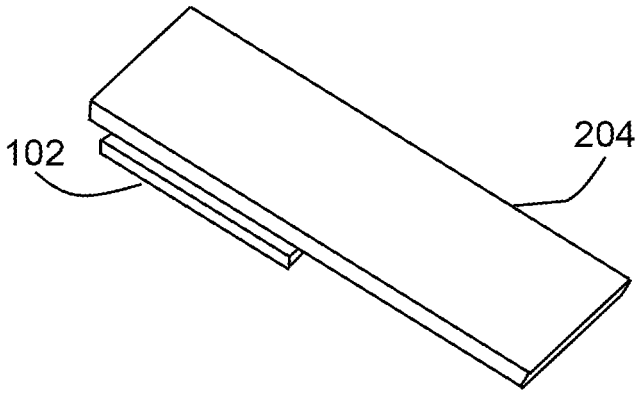
FIG. 8 shows aspects of a foldable game lighting and scorekeeping assembly according to exemplary embodiments hereof.

In some embodiments, as shown in FIGS. 6-8, the assembly 10 includes a foldable game lighting and scorekeeping assembly 12 adapted to transition from an upright configuration (for use) to a folded configuration (for stowage), and vice versa.

In some embodiments, the foldable assembly 12 includes a scorekeeping system's housing 204 provided with a lower portion 210. The lower portion 210 is positioned below the illuminated readouts 206 and configured with a cup holder assembly lateral support 302. Note that in this embodiment, the first and second readouts 206 are positioned adjacent vertically. As shown, the lateral support 302 includes a retractable tray 306 configured with the lower portion 210 using a rotatable mount 308. The retractable tray 306 is adapted to transition from an extended downward position (e.g., for use as shown in FIG. 6) to a retracted upward position (e.g., for stowage as shown in FIG. 7). The lower portion 210 may include an opening 310, recess, or other type of receiving structure (e.g., a cutout) that may receive and secure the tray 306. From its extended position, the tray 306 may be rotated upward in the direction of arrow C to be received and stowed into the opening 310. When stowed, it may be preferable that the tray 306 be flush with the front surface of the housing 204 and releasably locked using a locking mechanism. The tray 306 may then be released and lowered for use when desired. When in its extended configuration, it may be preferable that the tray 306 include a stop that holds the tray 306 stable and secure.

In some embodiments, the tray 306 includes cupholders 304 configured with its upper surface, and an illumination device 602 configured at or near its distal front end. In some embodiments, the illumination device 602 is configured with the tray 304 using a rotatable mount 604 that enables the illumination device 602 to be rotated from a generally upright position (for use as shown in FIG. 6) to a retracted position for stowage. The tray 306 may include a recess 312 or other type of receiving structure (e.g., a cutout) that may receive and secure the illumination device 602. From its upright position, the illumination device 602 may be rotated backwards in the direction of arrow D to be received and stowed into the recess 312 on the tray 304. When stowed, it may be preferable that the illumination device 602 be flush with the top surface of the tray 306 and releasably locked using a locking mechanism. The illumination device 602 may then be released and extended for use when desired.

In some embodiments, it may be preferable that the rotatable mount 604 include one or more detents (or other types of setting mechanisms such as pins, etc.) at different angular positions so that the angle of the illumination device 602, when in its generally upright position, may be adjusted and held in place at different angular settings. In this way, a user may adjust the angle of the illumination device 602 depending on the position of the game board GB1 below to ensure that the device 602 is aimed correctly and that the board GB1 is sufficiently lighted by the device 602. For example, as shown in FIG. 6, a user may adjust the direction of the light $L_2$ emitted by the device 602.

In some embodiments, the housing 204 is configured with the base 102 via one or more foldable legs 108. The foldable legs 108 are configured between the bottom (or other suitable location) of the housing 204 and the base 102 using rotatable mounts 110. In this way, the foldable assembly 12 may be folded into a compact configuration for stowage as described below.

FIG. 6 shows the foldable assembly 12 in its upright position for use. To convert the assembly 12 into a compact configuration, the housing 204 may be rotated forward and downward in the direction of arrow A, and the foldable legs 108 may be rotated downward in the direction of arrow B with respect to the base 102 as shown in FIG. 7. The elements 204, 108 may be rotated until the housing 204, the legs 108, and the base 102 are generally aligned horizontally with respect to one another. This is shown in FIG. 8.

It may be preferable that the rotatable mounts 110 include releasable locking mechanisms such that the housing 204 and the legs 108 may be locked in the assembly's fully upright position (for use), unlocked to convert the assembly 12 into its compact configuration, and then locked again in the compact position for safe stowage. These actions may be taken in reverse to extend the assembly 12 back into its upright and usable position.

While not shown in FIGS. 6-8, it is understood that the assembly 12 may include a bottle opener assembly 400 (e.g., configured with the tray 306) and/or an audio speaker system 500 (e.g., configured with the housing 204, the tray 306, etc.).

In any of the embodiments described herein, the game lighting and scorekeeping assembly 10, 12 may be integrated into one or more gameboards, and as such, may be attached directly to the one or more gameboards (e.g., at the rear of the gameboard behind the board's top playing surface so that the assembly 10, 12 not interfere or otherwise obstruct the gameplay). Regarding the foldable assembly 12, it may be preferable that the assembly 12 be integrated with the gameboard using rotatable mounts so that the assembly 12 and the gameboard may be folded together into a generally aligned horizontal arrangement for stowage.

Note that in this embodiment, the illumination device 602 of the assembly 12 is positioned below the scorekeeping readouts 206 such that the light $L_2$ emitted by the illumination device 602 does not interfere with the light $L_1$ emitted by the scorekeeping displays 206. As in other embodiments, the light $L_1$ is directed generally outward at a higher elevation than the light $L_2$, and the light $L_2$ is directed generally downward at a lower elevation than the light $L_1$. In this way, the light $L_2$ may not mask out the light $L_1$, especially from afar.

It is understood that any aspect and/or element of any of the embodiments described herein or otherwise may be combined in any way with any other aspect and/or element of any other embodiment to form additional embodiments of the assemblies 10, 12, all of which are within the scope of the assemblies 10, 12.

Those of ordinary skill in the art will appreciate and understand, upon reading this description, that embodiments hereof may provide different and/or other advantages, and that not all embodiments or implementations need have all advantages.

As used herein, including in the claims, the phrase "at least some" means "one or more," and includes the case of only one. Thus, e.g., the phrase "at least some ABCs" means "one or more ABCs," and includes the case of only one ABC.

As used herein, including in the claims, term "at least one" should be understood as meaning "one or more" and therefore includes both embodiments that include one or multiple components. Furthermore, dependent claims that refer to independent claims that describe features with "at least one" have the same meaning, both when the feature is referred to as "the" and "the at least one."

As used in this description, the term "portion" means some or all. For example, "A portion of X" may include some of "X" or all of "X." In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only," the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only," the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values, ranges, etc., in case these terms, features, values, ranges, etc., are used in conjunction with terms such as about, around, generally, substantially, essentially, at least, etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise," "including," "having," and "contain" and their variations should be understood as meaning "including but not limited to," and are not intended to exclude other components unless specifically so stated.

It will be appreciated that variations to the embodiments of the invention can be made while still falling within the scope of the invention. Alternative features serving the same, equivalent, or similar purpose can replace features disclosed in the specification unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance," "such as," "for example," ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A device support assembly for use with game boards, the device support assembly comprising:

an upright support structure including a first end and a second end defining a support structure longitudinal axis, the first end including a base adapted to support the upright support structure on a surface;

a tray including a proximal end and a distal end defining a tray longitudinal axis, and an upper surface extending between the proximal end and the distal end, the proximal end rotatably attached to the upright support structure, the upper surface adapted to transition from a first position to a second position, the first position with the tray longitudinal axis generally horizontal and the second position with the upper surface releasably locked with the tray longitudinal axis parallel to the support structure longitudinal axis for stowage of the tray;

a light emitting electronic scorekeeping device configured with the upright support structure; and an illumination system configured with the upright support structure;

wherein the illumination system is attached to the distal end of the tray such that the illumination system moves with the tray as the upper surface transitions from the first position to the second position;

wherein the illumination system is configured at a position on the upright support structure that is lower with respect to the position of the scorekeeping device.

2. The device support assembly of claim 1 further comprising a rotatable mount configured with the illumination system and with the upright support structure, the rotatable mount adapted to set the angular orientation of the illumination system.

3. The device support assembly of claim 1 further comprising a first opening in the upright support structure above the proximal end of the tray, at least a portion of the tray releasably held within the first opening when the upper surface of the tray is in its second position.

4. The device support assembly of claim 1 further comprising a rotatable mount configured between the illumination system and the distal end of the tray, the rotatable mount adapted to set an angular orientation of the illumination system.

5. The device support assembly of claim 4 wherein the tray includes a second opening adjacent the rotatable mount and at least one angular orientation of the illumination system is with at least a portion of the illumination system within the second opening for stowage of the illumination system.

6. The device support assembly of claim 1 further comprising at least one leg including a first end and a second end, the first end rotatably attached to a lower portion of the upright support structure and the second end rotatably attached to the base.

7. The device support assembly of claim 6 wherein the device support assembly is adapted to transition from a generally upright configuration to a generally flat configuration by rotating the at least one leg about its first end and about its second end.

8. The device support assembly of claim 1 further comprising an audio speaker system configured with the upright support structure.

9. The device support assembly of claim 1 further comprising a bottle opener configured with the upright support structure.

10. The device support assembly of claim 1 further comprising one or more cup holders configured with the upright support structure.

11. The device support assembly of claim 1 wherein the tray includes one or more cup holders and/or a bottle opener.

12. A device support assembly for use with game boards, the device support assembly comprising:

a frame structure including an upper portion and a lower portion beneath the upper portion; the upper portion and the lower portion defining a frame structure longitudinal axis;

a light emitting electronic scorekeeping device configured with the upper portion;

an illumination system configured with the lower portion;

a base adapted to support the frame structure on a surface;

a tray including a proximal end and a distal end defining a tray longitudinal axis, and an upper surface extending between the proximal end and the distal end, the proximal end rotatably attached to the upright support structure, the upper surface adapted to transition from a first position to a second position, the first position with the tray longitudinal axis generally perpendicular to the frame structure longitudinal axis and the second position with the upper surface releasably locked with the tray longitudinal axis parallel to the support structure longitudinal axis for stowage of the tray;

at least one leg including a first end and a second end, the first end rotatably attached to the lower portion of the frame structure and the second end rotatably attached to the base;

wherein the illumination system is attached to the distal end of the tray such that the illumination system moves with the tray as the upper surface transitions from the first position to the second position;

wherein light emitted by the illumination system is directed in a downward direction away from light emitted by the scorekeeping device.

13. The device support assembly of claim 1 further comprising a rotatable mount configured between the illumination system and the distal end of the tray, the rotatable mount adapted to set an angular orientation of the illumination system.

14. The device support assembly of claim 12 wherein the device support assembly is adapted to transition from a generally upright configuration to a generally flat configuration by rotating the at least one leg about its first end and about its second end.

15. The device support assembly of claim 12 wherein the tray includes one or more cup holders and/or a bottle opener.

16. A device support assembly for use with game boards, the device support assembly comprising:

a frame structure including a top end and a bottom end beneath the top end, the top end and the bottom end defining a frame structure longitudinal axis;

a light emitting electronic scorekeeping device configured with the top end;

a base configured with the bottom end and adapted to support the frame structure on a surface;

an illumination system configured with the frame structure at a location between the top end and the bottom end and below the light emitting electronic scoreboard, the illumination system aimed at a downward angle away from the light emitting electronic scoreboard;

a tray including a proximal end and a distal end defining a tray longitudinal axis, and an upper surface extending between the proximal end and the distal end, the proximal end rotatably attached to the frame structure, the upper surface adapted to transition from a first position to a second position, the first position with the tray longitudinal axis generally horizontal and the second position with the upper surface releasably locked with the tray longitudinal axis parallel to the frame structure longitudinal axis for stowage of the tray;

wherein the illumination system is attached to the distal end of the tray such that the illumination system moves with the tray as the upper surface transitions from the first position to the second position;

at least one leg including a first end and a second end, the first end rotatably attached to the lower portion of the frame structure and the second end rotatably attached to the base;

wherein the device support assembly is adapted to transition from a generally upright configuration to a generally flat configuration by rotating the at least one leg about its first end and about its second end.

17. The device support assembly of claim 3 wherein the upper surface is flush with the first opening when the upper surface is in the second position.

18. The device support assembly of claim 3 wherein the at least a portion of the tray is releasably held within the first opening using a locking mechanism.

* * * * *